US007089634B1

(12) United States Patent
Dunning

(10) Patent No.: US 7,089,634 B1
(45) Date of Patent: Aug. 15, 2006

(54) INTERLOCKING PIN SYSTEM

(76) Inventor: Sandy L. Dunning, 2208 Hampstead Ct., Safety Harbor, FL (US) 34695

( * ) Notice: Subject to any disclaimer, the term of this patent is extended or adjusted under 35 U.S.C. 154(b) by 20 days.

(21) Appl. No.: 10/405,380

(22) Filed: Apr. 2, 2003

(51) Int. Cl.
*A44B 1/04* (2006.01)
*A47H 13/00* (2006.01)
*A47H 1/00* (2006.01)
*A47C 21/02* (2006.01)

(52) U.S. Cl. ..... 24/707.4; 24/72.5; 5/498

(58) Field of Classification Search ..... 24/657, 24/671, 72.5, 707.2, 707.5, 707.6, 707.4, 24/707.9, 708, 708.6, 706, 711.2, 716; 63/12, 63/13; 5/494, 498
See application file for complete search history.

(56) References Cited

U.S. PATENT DOCUMENTS 1,484,807 A * 2/1924 Baker et al. ..... 24/110
3,311,958 A * 4/1967 Reeves ..... 24/707.2
5,970,588 A * 10/1999 Hurtz et al. ..... 24/657
6,317,941 B1 * 11/2001 Hamm, Jr. ..... 63/12
6,557,220 B1 * 5/2003 Hamm, Jr. ..... 24/705
6,612,131 B1 * 9/2003 Cheng ..... 24/707.4

* cited by examiner

*Primary Examiner*—Robert J. Sandy
(74) *Attorney, Agent, or Firm*—Edward P. Dutkiewicz

(57) ABSTRACT

A base disk has a top face with a coaxial coupling pin with a pointed tip, spacer portions and notches. A coupling housing has a lower surface with an aperture. The housing has a releasable coupling mechanism. Male and females ends of the coupling mechanism are situated opposite each other and around the aperture. The male and female ends have biasing means and each has a pair of inward flanges with apertures and an outward tab. A supplemental member couples to the upper surface of the coupling housing.

9 Claims, 8 Drawing Sheets

FIG 1
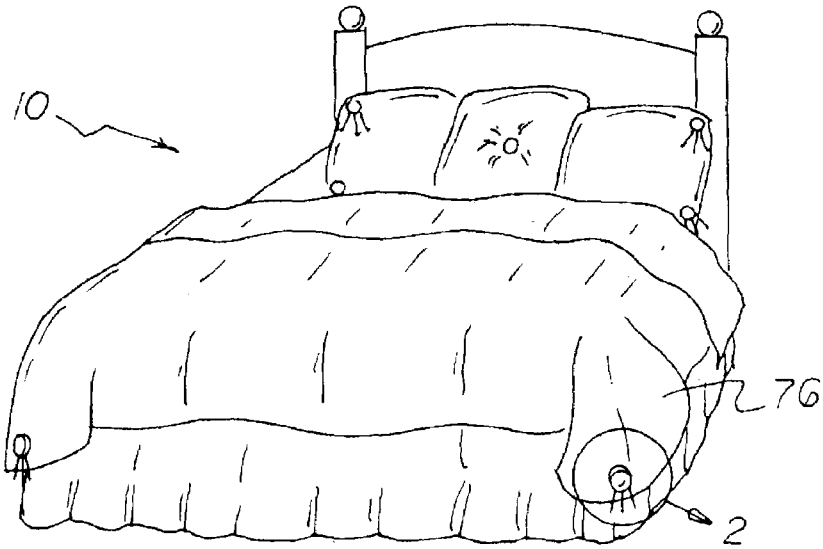
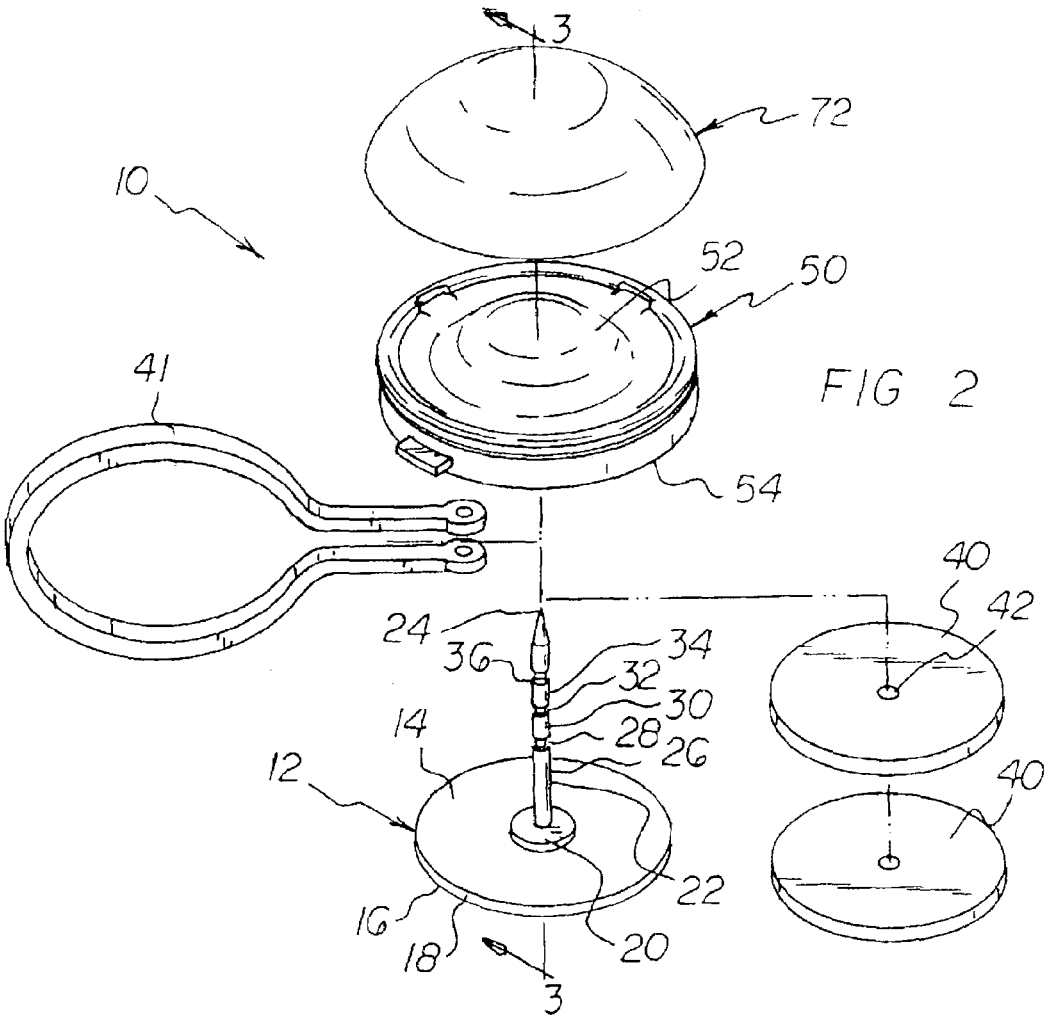
FIG 2

FIG 3
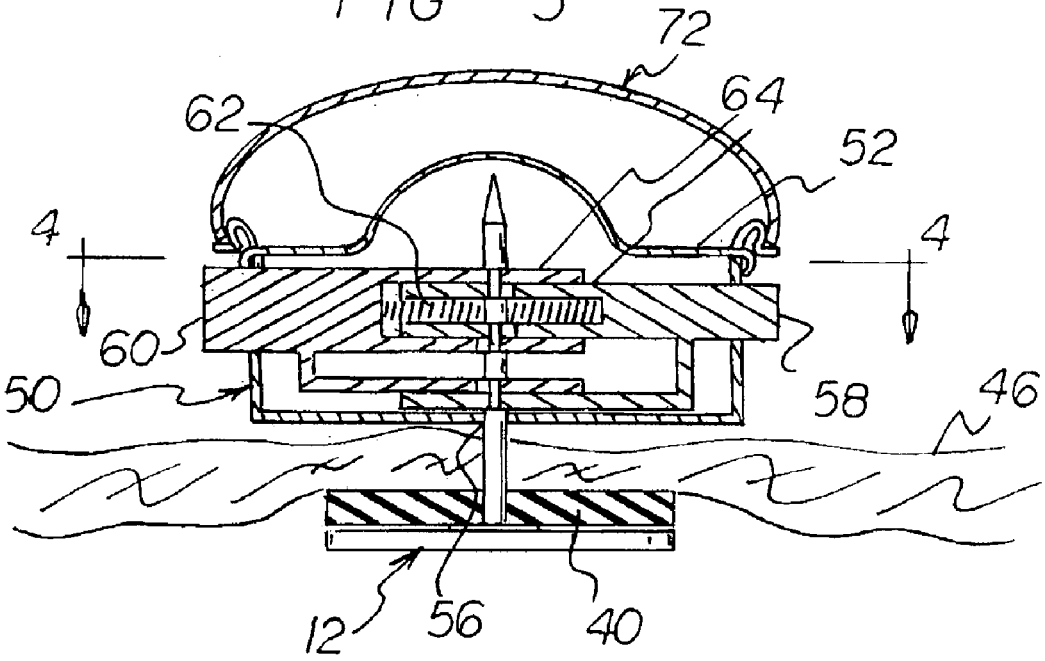
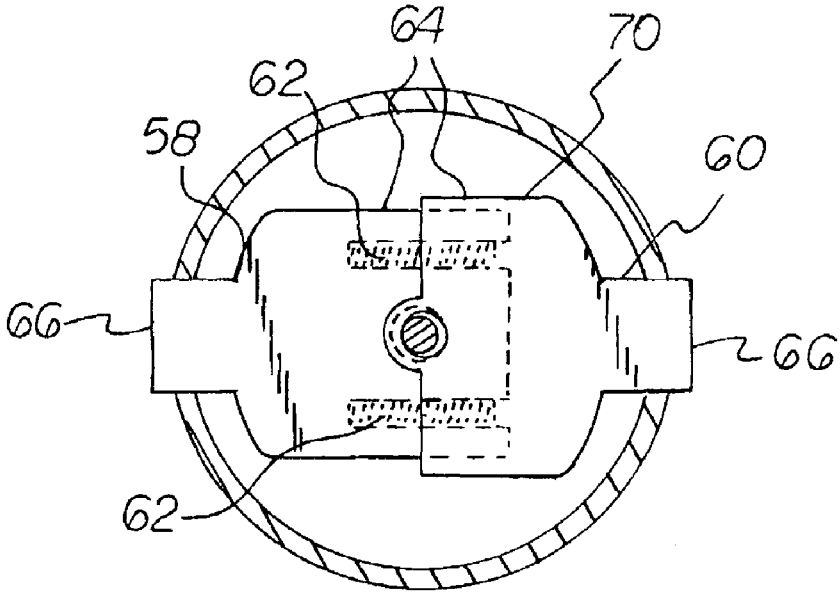
FIG 4

FIG 3A
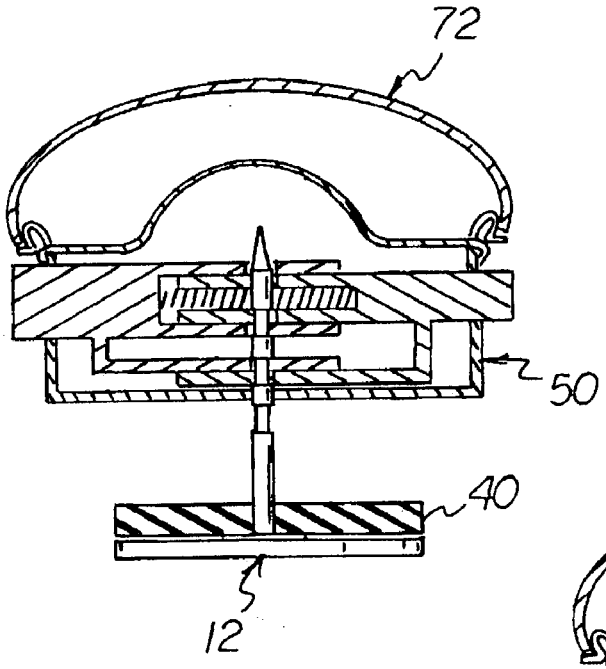
FIG 3C
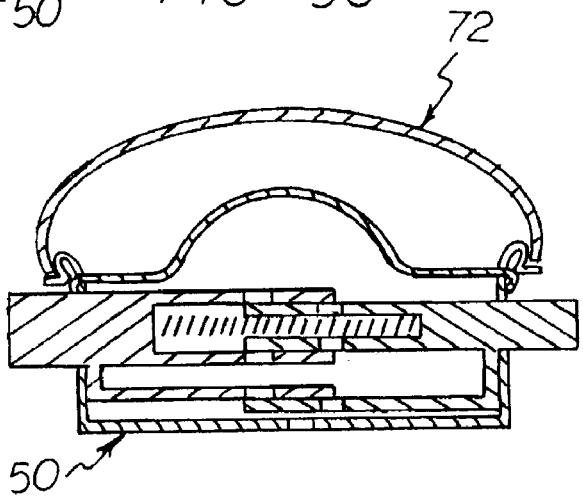
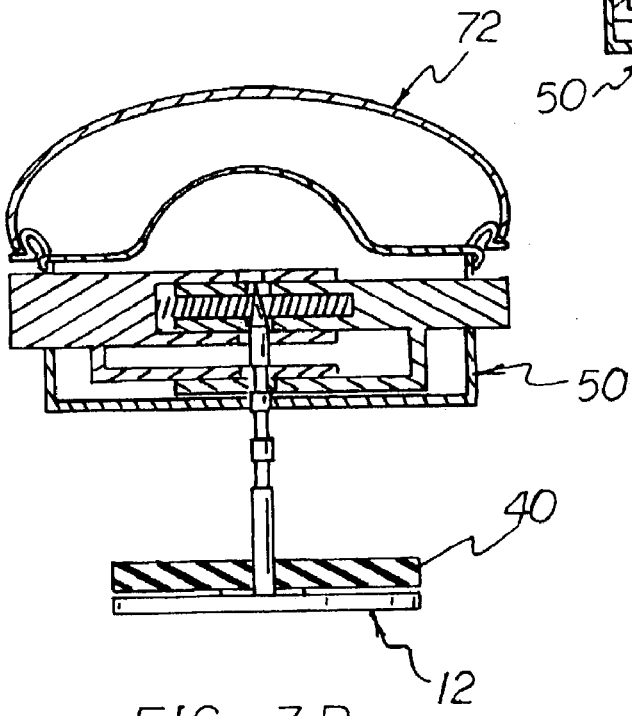
FIG 3B

FIG 11
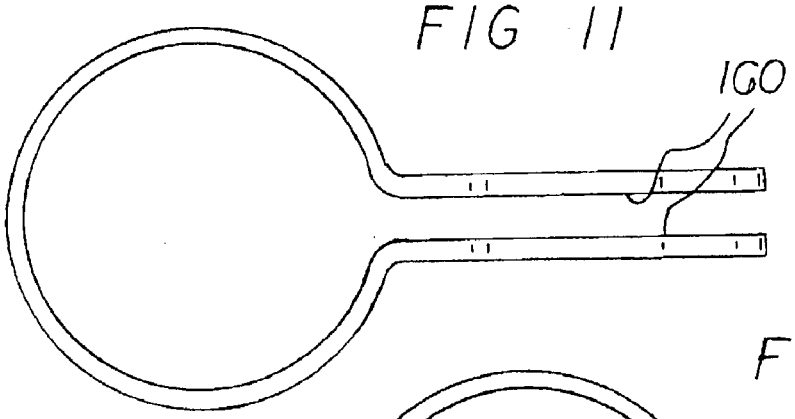
FIG 12
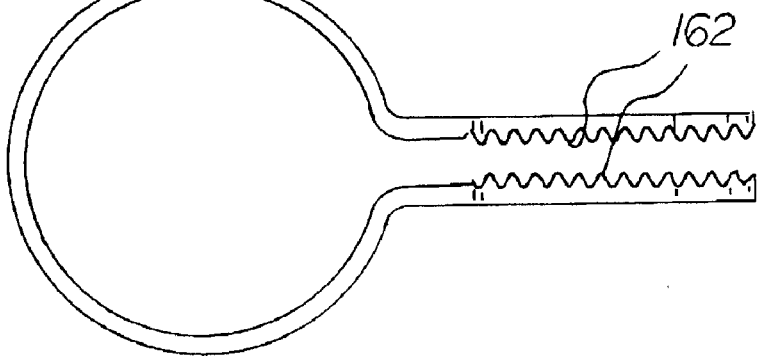
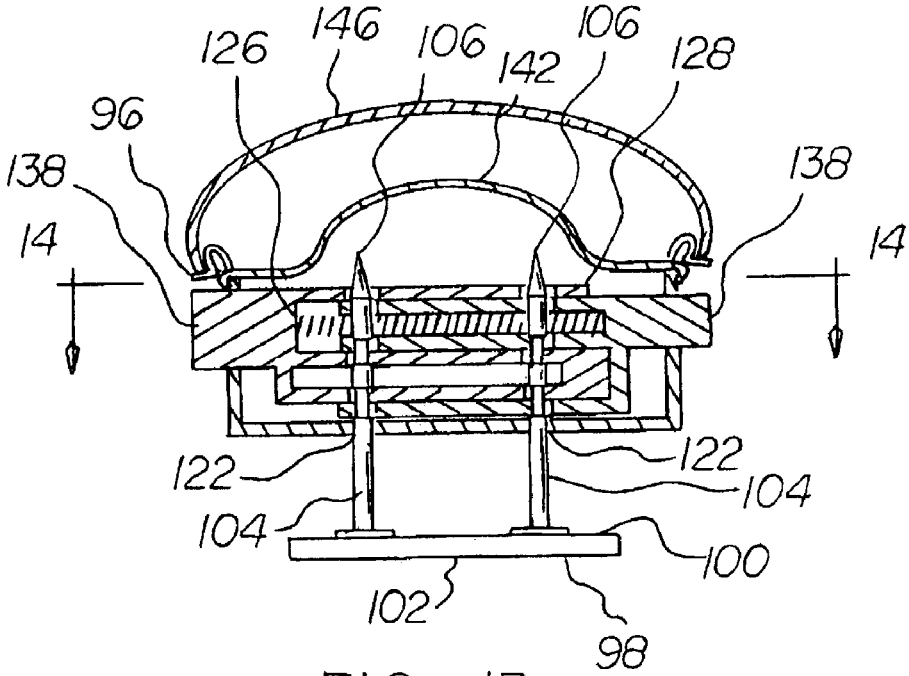
FIG 13

FIG 14
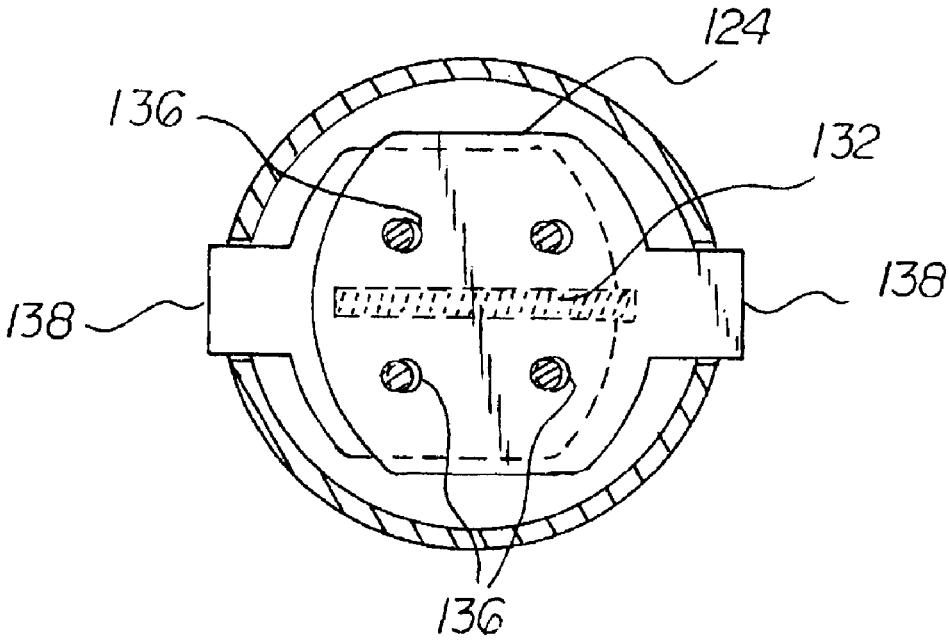
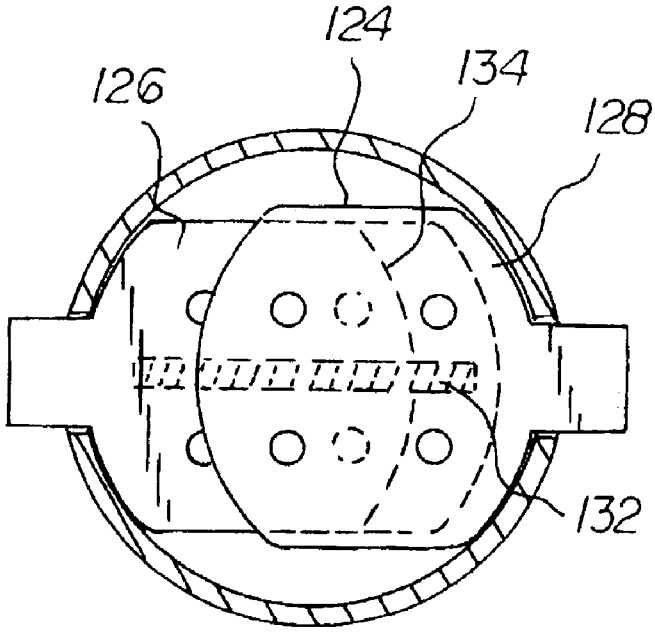
FIG 15

INTERLOCKING PIN SYSTEM

BACKGROUND OF THE INVENTION

1. Field of the Invention

The present invention relates to an interlocking pin system and more particularly pertains to decorating and securing duvet covers to down comforters, and also pertains to decorating and/or securing apparel, upholstery, and the like.

2. Description of the Prior Art

The use of pin systems of known designs and configurations is known in the prior art. More specifically, pin systems of known designs and configurations previously devised and utilized for the purpose of decorating and securing materials through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 3,534,446 to Silver discloses a fastener with ornamental front. U.S. Pat. No. 3,623,192 to Papazian discloses a button. U.S. Pat. No. 3,928,896 to Puckett discloses a fastener. U.S. Pat. No. 5,542,157 to Herman discloses decorative multi-part button assemblies and use thereof. U.S. Pat. No. 4,507,344 to Baughman discloses a pin with detachable face. U.S. Pat. No. 4,793,155 to Law discloses jewelry with interchangeable ornamentation. U.S. Pat. No. 5,940,942 to Fong discloses a fabric holder. U.S. Pat. No. 5,946,777 to Weatherall discloses a button device. U.S. Pat. No. 3,701,174 to Randolph discloses a quilt and cushion construction and button therefor. U.S. Pat. No. 4,817,251 to Shirley-Smith et al. discloses a fastener for attaching buttons and the like to fabric. Lastly, European Patent Application No. EP 1 159 901 Alto Yang and discloses a cover for a duvet.

While these devices fulfill their respective, particular objectives and requirements, the aforementioned patents do not describe an interlocking pin system that allows decorating and securing duvet covers to down comforters and that allows decorating and/or securing apparel, upholstery, and the like.

In this respect, the interlocking pin system according to the present invention substantially departs from the conventional concepts and designs of the prior art, and in doing so provides an apparatus primarily developed for the purpose of decorating and securing duvet covers to down comforters and for the purpose of decorating and/or securing apparel, upholstery, and the like.

Therefore, it can be appreciated that there exists a continuing need for a new and improved interlocking pin system which is removable and adjustable and which can be used for decorating and securing duvet covers to down comforters and can also be used for decorating and/or securing apparel, upholstery, and the like. In this regard, the present invention substantially fulfills this need.

SUMMARY OF THE INVENTION

In view of the foregoing disadvantages inherent in the known types of pin systems of known designs and configurations now present in the prior art, the present invention provides an improved interlocking pin system. As such, the general purpose of the present invention, which will be described subsequently in greater detail, is to provide a new and improved interlocking pin system and method which has all the advantages of the prior art and none of the disadvantages.

To attain this, the present invention essentially comprises a base disk. The base disk is of a first diameter. The base disk has a thin cylindrical configuration. The base disk also has a top face, a bottom face and a periphery therearound. The top face has a concentric raised cylinder. The concentric raised cylinder is of a second diameter. The second diameter is less than the first diameter. A coaxial coupling pin is provided. The coupling pin extends from the raised cylinder. The coupling pin is of a third diameter. The third diameter is less than the first diameter and second diameter. The coupling pin has a pointed tip. A first spacer bottom portion is provided. A first notch is also provided. A second spacer portion is further provided. A second notch is provided as well. A third spacer portion is also provided. Further provided is a third notch.

A spacer disk is provided. The spacer disk is in a thin cylindrical configuration. The spacer disk is of a fourth diameter. The fourth diameter is similar to the first diameter. The spacer disk has a central aperture. The spacer disk is adapted to be received by the coupling pin of the base disk and lie adjacent to the raised cylinder of the base.

Provided next is a piece of material. The material is also adapted to be pierced by the coupling pin of the base disk.

Further provided is a coupling housing. The coupling housing is of a generally cylindrical configuration. The coupling housing has a convex upper member coupled to the housing at the periphery. The coupling housing also has a planar lower surface. The planar lower surface has a central aperture. The coupling housing is adapted to house a releasable coupling mechanism. The releasable coupling mechanism is comprised of a male end and a female end. The male and female ends are situated opposite each other and around the cental aperture. The male and female ends are biased by a pair of springs. The male end and the female end each have a pair of inward flanges. The flanges have apertures and an outward tab. The male and female ends have a resting state. In the resting state the biasing springs force the apertures on the flanges to be displaced from each other. The flanges no longer lie in a central axis and a compressed state. In the compressed state the male end and female end are brought within close proximity to each other by compressing the outward tab and aligning the apertures of inward flanges. In this manner the coupling pin is allowed to be inserted such that when the coupling mechanism is released to its resting state the flanges will rest within the notches of the coupling pin.

Provided last is a decorative convex dome. The decorative convex dome is adapted to couple to the upper surface of the coupling housing.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved interlocking pin system which has all of the advantages of the prior art pin systems of known designs and configurations and none of the disadvantages.

It is another object of the present invention to provide a new and improved interlocking pin system which may be easily and efficiently manufactured and marketed.

It is further an object of the present invention to provide a new and improved interlocking pin system which is of durable and reliable constructions.

An even further object of the present invention is to provide a new and improved interlocking pin system which is susceptible of a low cost of manufacture with regard to both materials and labor, and which accordingly is then susceptible of low prices of sale to the consuming public, thereby making such interlocking pin system economically available to the buying public.

Even still another object of the present invention is to provide an interlocking pin system for decorating and securing duvet covers to down comforters and also for decorating and/or securing apparel, upholstery, and the like.

Lastly, it is an object of the present invention to provide a new and improved interlocking pin system comprising a base disk. The base disk has a top face, a bottom face and a periphery. The top face has a coaxial coupling pin with a pointed tip. The pin has spacer portions and notches. A coupling housing is provided. The housing has an upper member. The housing has a lower surface. The lower surface has an aperture. The housing has a releasable coupling mechanism. The coupling mechanism has a male end and a female end. The male and females ends are situated opposite each other and around the aperture. The male and female ends have biasing means. The male end and the female end each have a pair of inward flanges. The flanges have apertures and an outward tab. Further provided is a decorative member. The decorative member is adapted to couple to the upper member of the coupling housing.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective illustration of the present invention in association with pillows and a duvet cover.

FIG. 2 is an exploded illustration of the present invention taken from circle 2 of FIG. 1.

FIG. 3 is a cross sectional illustration of the present invention taken along line 3—3 of FIG. 2 and with the housing close to the disk and in the compressed state.

FIG. 3A is a cross sectional illustration of the present invention taken along line 3—3 of FIG. 2 and with the housing close to the disk and in the compressed state wherein the housing is spaced an intermediate distance form the disk and in the compressed state.

FIG. 3B is a cross sectional illustration of the present invention taken along line 3—3 of FIG. 2 where the housing is spaced an extended distance from the disk and in the compressed state.

FIG. 3C is a cross sectional illustration of the present invention taken along line 3—3 of FIG. 2 where the coupling mechanism is in the resting state.

FIG. 4 is a plan view of the present invention taken along line 4—4 of FIG. 3.

FIG. 11 is a side elevational view taken at line 11—11 of FIG. 10 showing the rod ring with smooth surfaces.

FIG. 12 is a side elevational view taken at line 11—11 of FIG. 10 but showing the rod ring with serrated surfaces.

FIG. 13 is a cross sectional illustration of the multi-pin interlocking pin system of FIGS. 8, 9 and 10.

FIG. 14 is a cross sectional illustration taken along line 14—14 of FIG. 13 showing the housing in a compressed state.

FIG. 15 is a cross sectional illustration taken along line 14—14 of FIG. 13 showing the housing in a resting state.

The same reference numerals refer to the same parts throughout the various Figures.

DESCRIPTION OF THE PREFERRED EMBODIMENT

Figure 5:
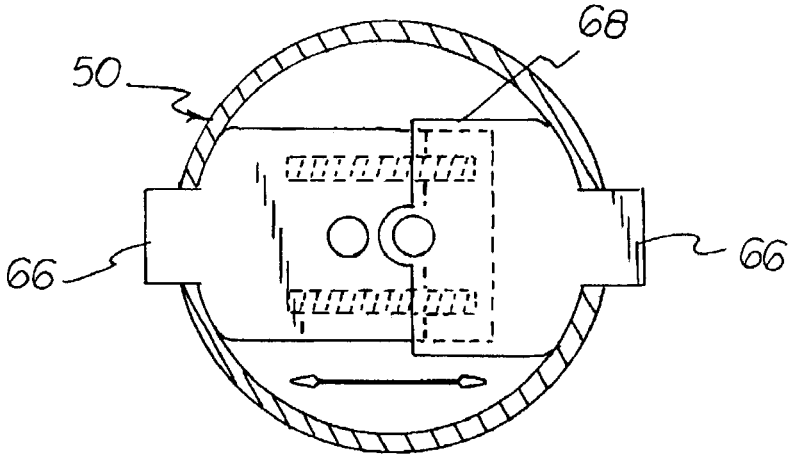
FIG. 5 is a plan view of the present invention wherein the coupling mechanism is in the resting state.

With reference now to the drawings, and in particular to FIG. 1 thereof, the preferred embodiment of the new and improved interlocking pin system embodying the principles and concepts of the present invention and generally designated by the reference numeral 10 will be described.

The present invention, the interlocking pin system 10 is comprised of a plurality of components. Such components in their broadest context include a base disk, a coupling housing, and a decorative convex member. Such components are individually configured and correlated with respect to each other so as to attain the desired objective.

First provided is a base disk 12. The base disk is of a first diameter. The base disk has a thin cylindrical configuration. The base disk also has a top face 14, a bottom face 16 and a periphery 18 there around. The top face has a concentric raised cylinder 20. The concentric raised cylinder is of a second diameter. The second diameter is less than the first diameter. A coaxial coupling pin 22 is provided. The coupling pin extends from the raised cylinder. The coupling pin is of a third diameter. The third diameter is less than the first diameter and second diameter. The coupling pin has a pointed tip 24. Preferably, the pin is about 0.625 inches, plus or minus 10 percent, in length and about 0.125 inches, plus or minus 10 percent, in diameter, and the longest portion without notches is at the end of the pin opposite from the tip. A first spacer bottom portion 26 is provided. A first notch 28 is also provided. A second spacer portion 30 is further provided. A second notch 32 is provided as well. A third spacer portion 34 is also provided. Further provided is a third notch 36. The various notches allow for the various spacings between the housing and the disk.

A spacer disk 40 is provided. The spacer disk is in a thin cylindrical configuration. The spacer disk is of a forth diameter. The fourth diameter is similar to the first diameter. The spacer disk has a central aperture 42. The spacer disk is adapted to be received by the coupling pin of the base disk and lie adjacent to the raised cylinder of the base. No spacer disk would be utilized for thick fabric layers. One or more disks would be utilized for the thinner fabric layers.

Provided next is a piece of material 46. The material is also adapted to be pierced by the coupling pin of the base disk.

Further provided is a coupling housing 50. The coupling housing is of a generally cylindrical configuration. The coupling housing has a convex upper cap member 52 coupled to the housing at the periphery for safety purposes. The coupling housing also has a planar lower surface 54. The planar lower surface has a central aperture 56. The coupling housing is adapted to house a releasable coupling mechanism. The releasable coupling mechanism is comprised of a male end 58 and a female end 60. The male and female ends are situated opposite each other and around the cental aperture. The male and female ends are biased by a pair of springs 62. The male end and the female end each have a pair of inward flanges 64. The flanges have apertures and an outward tab 66. The male and female ends have a resting state 68. In the resting state the biasing springs force the apertures on the flanges to be displaced from each other. The flanges no longer lie in a central axis and a compressed state 70. In the compressed state the male end and female end are brought within close proximity to each other by compressing the outward tab and aligning the apertures of inward flanges. In this manner the coupling pin is allowed to be inserted such that when the coupling mechanism is released to its resting state the flanges will rest within the notches of the coupling pin.

FIGS. 3, 3A, 3B and 4 illustrate the housing in the compressed state for adjustment purposes. FIG. 3 illustrates the housing at a short distance from the disk for relatively thin fabrics. FIG. 3A illustrates the housing at an intermediate distance from the disk for intermediate fabrics. FIG. 3B illustrates the housing at an extended distance for heavy fabrics. FIGS. 3C and 5 illustrate the housing in the resting state. When in use and attached to fabric, one or more spacer disks may be utilized. In association therewith, a ring 41 may be utilized whereby a system may be hung from a rod such as a curtain rod. The ring has a circular section for a receiving a rod, elongated fingers and apertured ends for receiving the pin of the base disk.

Provided last is a decorative convex dome 72. The decorative convex dome is adapted to removably couple to the upper member of the coupling housing for varying the appearance of the system. Further, the overall system is removable for varying the appearance of the duvet cover, apparel, upholstery, and the like, as desired and for the cleaning thereof.

In an alternate embodiment of the present invention the heavy fabric is a duvet cover 76.

Figure 6:
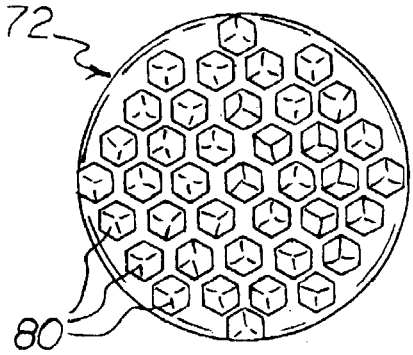
FIG. 6 is a plan view of an alternative embodiment of the present invention wherein the decorative dome has a plurality of decorative surfaces thereon.

In another alternate embodiment, the decorative member has a plurality of decorative surfaces 80 thereon. Note FIG. 6.

Figure 7:
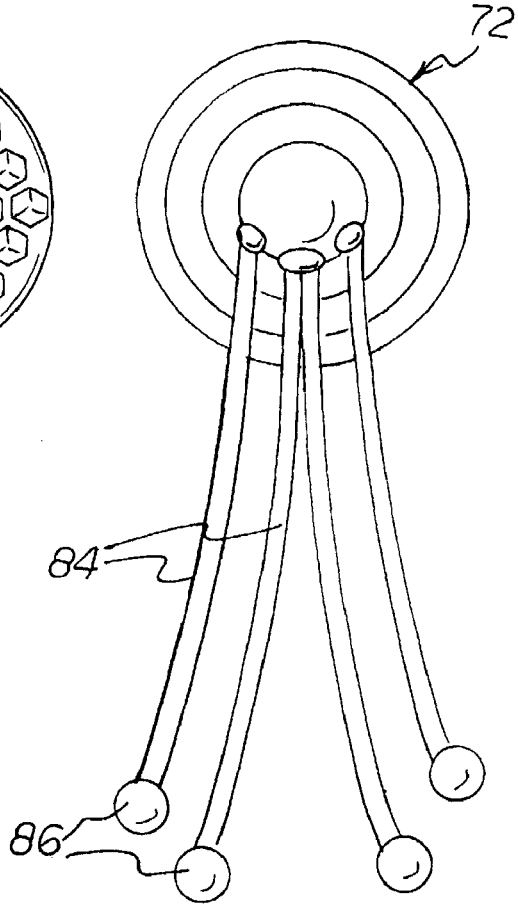
FIG. 7 is a plan view of an alternative embodiment of the present invention wherein the decorative dome has a plurality of decorative ribbon and beads.
Figure 8:
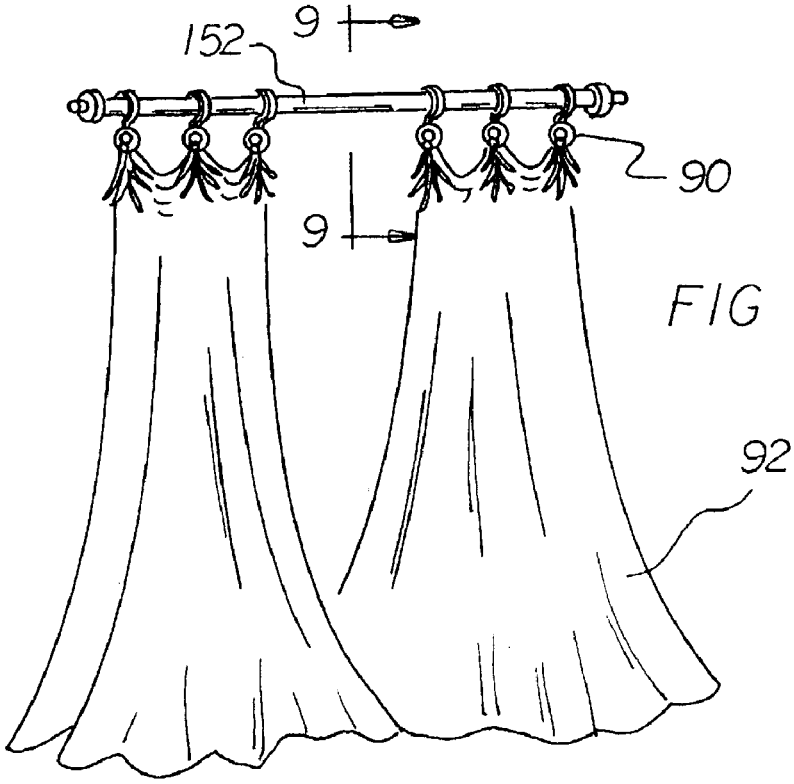
FIG. 8 is a front elevational view of a major alternate embodiment of the invention having a multi-pin interlocking pin system which has particular utility in association with draperies.

In still another alternate embodiment, the decorative member has a plurality of decorative ribbons 84 and/or beads 86 thereon. Note FIG. 7.

FIGS. 8 through 15 illustrate a major alternate embodiment of the invention having a multi-pin interlocking pin system 90 which has particular utility in association with draperies 92.

A major aspect of this embodiment is a multipin interlocking pin system 96. Such system includes a multipin base disk 98 with an inner face 100 and an outer face 102 and a periphery there around. The inner face has a plurality of coupling pins 104. Each pin has a pointed tip 106. Each pin also has a plurality of spacer portions 108 with notches 112 between the spacer portions. The number of notches and spacers are a function of a particular application. Optionally, one or more spacer disks 114 with apertures in number corresponding to the number of pins on the base disk may also be utilized as a function of the particular application.

Another component of the system is a coupling housing 116. The housing has an upper member 118 and a lower surface 120 with apertures 122. The system also has a releasable coupling mechanism 124. The coupling mechanism comprises a male end 126 and a female end 128. Such ends are situated opposite each other and around the apertures. Between the ends is a coil spring 132 for functioning as a biasing means. A single stronger spring is employed in this embodiment but the single and double spring embodiments are essentially interchangeable. The male end and the female end each have a pair of inward flanges 134 with apertures 136 and an outward tab 138.

The system further including a cap member 142 positionable over the upper member of the housing. The cap member is for safety purposes to preclude a user from pricking of a finger on the point of a pin.

Figure 9:
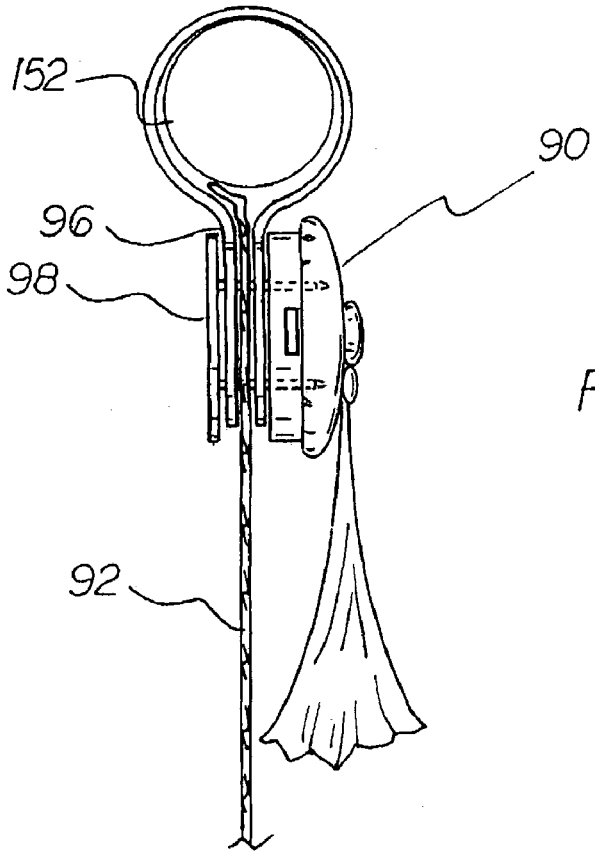
FIG. 9 is a cross sectional illustration of the present invention taken along line 9—9 of FIG. 8.
Figure 10:
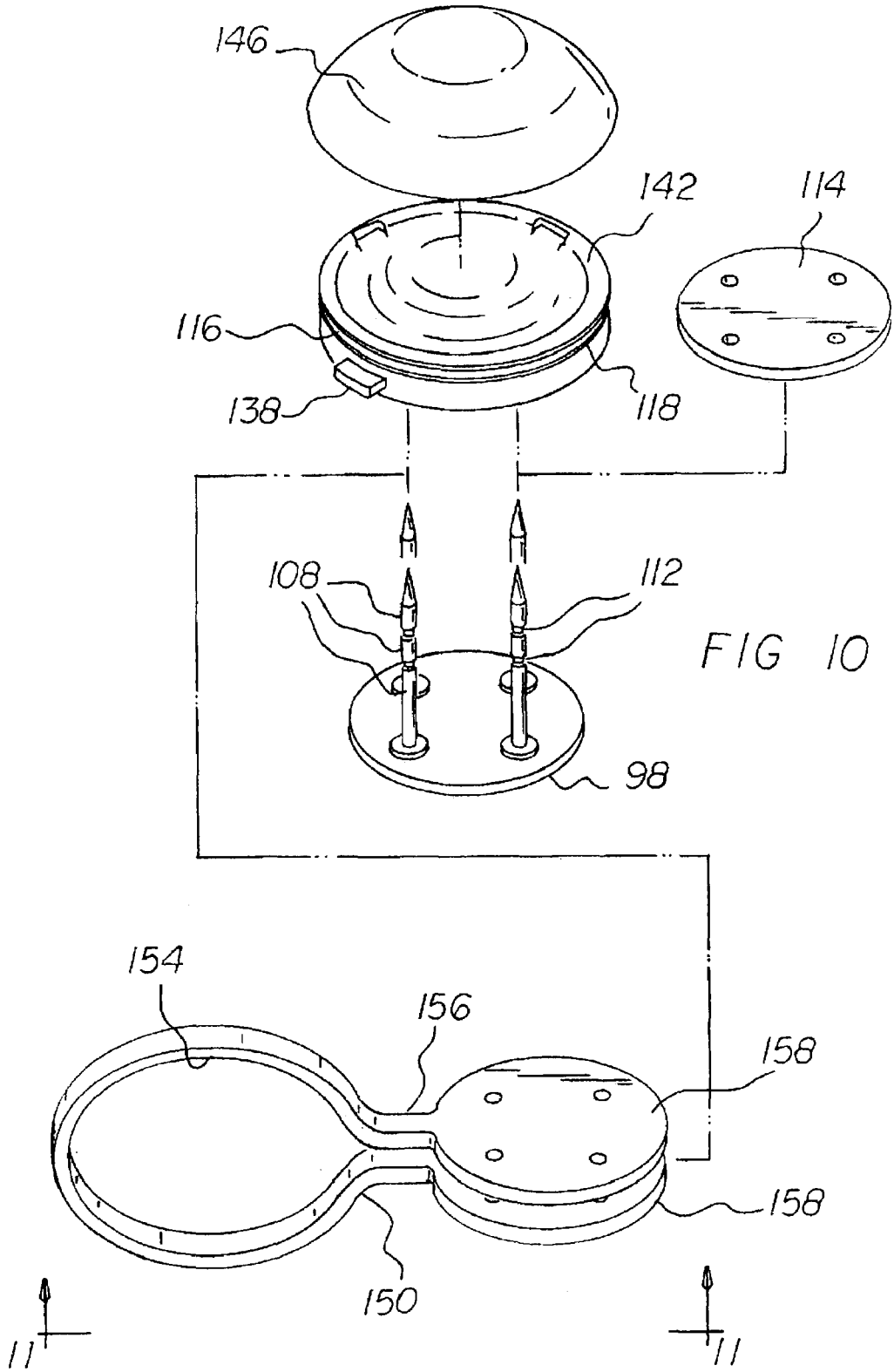
FIG. 10 is an exploded perspective illustration of the major alternate embodiment taken at the multi-pin interlocking pin system of FIGS. 8 and 9.

The system further includes a decorative convex dome member 146. Such dome is removably positionable on the pin system. It is removable for changing the appearance of the overall system and may be positioned on the convex dome member side or on the base disk side or on both sides. The decorations on the dome member may be a piece of fabric as shown in FIG. 9 or any of the other decorations as shown for example in FIGS. 6 and 7.

Lastly, the system further includes a ring 150. Such ring renders the system as adaptable to be hung from a rod 152 such as a curtain rod or shower rod. The ring has a circular section 154 for receiving the rod from which the ring and draperies hang. The ring also includes elongated fingers 156 and apertured ends 158. The apertures in the apertured end are for receiving the pins of the base disk. The apertured ends in one embodiment have smooth facing surfaces 160. Note FIG. 11. The apertured ends in the other embodiment have serrated facing surfaces 162 as for heavier fabrics. Note FIG. 11.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. An interlocking pin system adapted to decorate duvets, apparel and upholstery comprising, in combination:

a base disk of a first diameter and having a thin cylindrical configuration with a top face, a bottom face and a periphery there around, the top face having a concentric raised cylinder of a second diameter less than the first diameter and a coaxial coupling pin extending from the raised cylinder, the coupling pin of a third diameter less than the first diameter and second diameter and having a pointed tip, a first spacer bottom portion, a first notch, a second spacer portion, a second notch, a third spacer portion and a third notch;

a spacer disk of a thin cylindrical configuration of a forth diameter similar to the first diameter and having a central aperture adapted to be received by the coupling pin of the base disk and lie adjacent to the raised cylinder of the base;

a piece of material adapted to be pierced by the coupling pin of the base disk;

a coupling housing of a generally cylindrical configuration with a convex upper member coupled to the periphery and with a planar lower surface with a central aperture, the coupling housing being adapted to house a releasable coupling mechanism comprising a male end and a female end being situated opposite each other and around the cental aperture and biased by a pair of springs, the male end and the female end each having a pair of inward flanges with apertures and an outward tab, the male and female ends having a resting state where the biasing springs force the apertures on the flanges to be displaced from each other and no longer lie in a central axis and a compressed state where the male end and female end brought within close proximity to each other by compressing the outward tab and aligning the apertures of inward flanges allowing the coupling pin to be inserted such that when coupling mechanism is released to its resting state the flanges will rest within the notches of the coupling pin; and a decorative convex dome adapted to couple to the upper member of the coupling housing.

2. An interlocking pin system comprising:

a base disk with a top face, a bottom face and a periphery there around, the top face having a coaxial coupling pin with a pointed tip, a plurality of spacer portions and a plurality of notches; and a coupling housing with an upper member, a lower surface with an aperture, and a releasable coupling mechanism comprising a male end and a female end being situated opposite each other and around the aperture and having biasing means, the male end and the female end each having a pair of inward flanges with apertures and an outward tab.

3. The system as set forth in claim 2 and further including a supplemental member adapted to couple to the upper surface of the coupling housing.

4. The system as set forth in claim 2 and further including a fabric adapted to be pierced by the pin.

5. The system as set forth in claim 3 wherein the fabric is a duvet cover with a down comforter.

6. The system as set forth in claim 2 wherein the pin is about 0.625 inches, plus or minus 10 percent, in length and about 0.125 inches, plus or minus 10 percent, in diameter, and with the longest portion without notches being at the end of the pin opposite from the tip.

7. The system as set forth in claim 2 wherein the decorative member has a plurality of decorative surfaces thereon.

8. The system as set forth in claim 2 wherein the decorative member has a plurality of decorative ribbons thereon.

9. The system as set forth in claim 2 wherein the decorative member has a plurality of decorative beads thereon.

* * * * *